US005697715A

United States Patent [19]

Kuroda et al.

[11] Patent Number: 5,697,715

[45] Date of Patent: Dec. 16, 1997

[54] MARKED GOLF BALL TRANSFER FOIL THEREFOR AND PREPARATION OF GOLF BALL USING TRANSFER FOIL

[75] Inventors: Kenjiro Kuroda, Tokyo; Susumu Muta, Yokohama, both of Japan

[73] Assignees: Toppan Printing Co., Ltd.; Bridgestone Sports Co., Ltd., both of Tokyo, Japan

[21] Appl. No.: 510,070

[22] Filed: Aug. 1, 1995

[51] Int. Cl.[6] ..... B41J 31/00

[52] U.S. Cl. ..... 400/237; 101/DIG. 40

[58] Field of Search ..... 400/237; 101/DIG. 40; 106/31.01

[56] References Cited

U.S. PATENT DOCUMENTS

| | | | |
|---|---|---|---|
| 3,647,221 | 3/1972 | Holley | 101/DIG. 40 |
| 4,064,194 | 12/1977 | Evans et al. | 260/859 R |
| 4,933,259 | 6/1990 | Chihara et al. | 430/280 |
| 5,286,559 | 2/1994 | Kaneko et al. | 428/341 |
| 5,290,623 | 3/1994 | Kawahito et al. | 428/195 |
| 5,298,034 | 3/1994 | Bast et al. | 8/552 |
| 5,362,549 | 11/1994 | Imamura et al. | 428/195 |
| 5,420,613 | 5/1995 | Saisho et al. | 347/217 |
| 5,456,969 | 10/1995 | Suzuki et al. | 428/195 |
| 5,484,644 | 1/1996 | Imamura et al. | 428/195 |

FOREIGN PATENT DOCUMENTS

| | | |
|---|---|---|
| 509829 | 10/1992 | European Pat. Off. . |
| 59-67053 | 4/1984 | Japan . |
| 61-255968 | 11/1986 | Japan . |
| 4-296588 | 10/1992 | Japan . |

OTHER PUBLICATIONS

Abstract of Japanese Patent Application Kokai 53–63137 (JP–A 63137/1978).

Abstract of Japanese Patent Application Kokai 57–69087 (JP–A 69087/1982).

Abstract of Japanese Utility Model Application Kokai 63269/1992.

*Primary Examiner*—Edgar S. Burr
*Assistant Examiner*—Daniel J. Colilla
*Attorney, Agent, or Firm*—Sughrue, Mion, Zinn, Macpeak & Seas, PLLC

[57] ABSTRACT

A transfer foil for use in marking a golf ball has an ink layer on a base film. The ink layer is constructed by a urethane resin having a hydroxyl value of 0.2 to 15. The ink layer is transferred from the foil to the golf ball to form a marking by pressing the foil against the ball by means of a flat rubber pad. A two-part urethane resin composition is then spray coated onto the golf ball so as to cover the marking, dried and cured thereto. During the process, hydroxyl groups of the ink layer urethane resin react with isocyanate groups available from the urethane resin coating composition whereby the marking is durable.

9 Claims, 1 Drawing Sheet

MARKED GOLF BALL TRANSFER FOIL THEREFOR AND PREPARATION OF GOLF BALL USING TRANSFER FOIL

BACKGROUND OF THE INVENTION

1. Technical Field

This invention generally relates to a golf ball. More particularly, it relates to a transfer foil for use in marking a golf ball and a method for preparing a marked golf ball using the transfer foil.

2. Prior Art

Various techniques are used in marking of golf balls. Known techniques include a direct printing technique as typified by a pad printing technique, a transfer technique of stamping a solid transfer foil against a ball surface by means of a marking press, and a heat transfer technique using a transfer foil having a desired pattern of transfer ink layer on a film as disclosed in Japanese Patent Application Kokai (JP-A) No. 63137/1978.

A transfer foil for use in marking of golf balls is also disclosed in JP-A 69087/1982. This transfer foil is prepared by applying an ink composition to a polypropylene film to form an ink layer thereon. The ink composition contains nitrocellulose and an alkyd resin as base resins, a pigment or dye as a coloring agent, and particulate polyethylene, plasticizer and surfactant as additives dissolved or dispersed in an organic solvent.

JP-A 183285/1983 discloses a similar transfer foil for use in marking of golf balls which is prepared by applying an ink composition to a polypropylene film to form an ink layer thereon. The ink composition contains nitrocellulose and a polyamide, hard resin, acrylic, polyester or urethane resin as base resins or a vinyl or acrylic resin as a base resin, a pigment or dye as a coloring agent, and particulate polyethylene, extending pigment, plasticizer and surfactant as additives dissolved or dispersed in an organic solvent.

The direct printing technique as typified by a pad printing technique has several problems that multi-color marking requires drying after every color printing resulting in low efficiency, the use of solvent has an adverse influence on the working environment, and printed marks are often distorted and inconsistent because the surface to be printed is curved.

In the stamping transfer technique using a solid transfer foil, the foil is not cut exactly along a cutting line upon stamping, leaving fins or burrs and imprinted marks are often distorted. This technique is uneconomical since only parts of the foil are utilized. Another drawback is difficult alignment for multi-color marking.

The transfer foil of JP-A 63137/1978 has a desired pattern of marking ink between a stripping layer and an adhesive layer, resulting in an increased thickness dimension. Burrs are often left. Transfer conditions include high pressure and high temperature, which can damage the substrate to receive transfer marks, that is, golf ball.

The transfer technique of JP-A 69087/1982 eliminates the above-mentioned drawbacks, but still requires a transfer temperature as high as 180° C. at which the base film of the transfer foil can be thermally wrinkled to distort transfer marks.

The transfer technique of JP-A 183285/1983 enables transfer at a temperature of 160° C. which is lower than that of JP-A 69087/1982, but still high enough to cause the base film to be thermally wrinkled because the base film used is a biaxially oriented polypropylene film. If transfer is carried out at a lower temperature so as to avoid thermal wrinkles, some characters can be chipped off. For effective transfer, the rubber pad used is a cylindrical one defining a curvilinear inner surface having a curvature of 40 mm. A special jig must be built in the transfer machine for mounting the pad of such shape. The maintenance of the pad itself is difficult. All these factors adversely affect productivity. An image or transferred mark remains weak since the resin used in the ink layer is not reactive with a urethane coating liquid to be subsequently applied thereover.

Japanese Utility Model Application Kokai No. 63269/1992 discloses a transfer paper sheet for use in marking of golf balls which is prepared by printing a polypropylene film with pigmented ink containing a polyamide resin having a softening point of 90° to 120° C. or a urethane resin having a softening point of 90° to 100° C. as a main binder. This transfer paper sheet is heat pressed against the golf ball surface by means of a silicone rubber pad configured in conformity with the golf ball. Since no treatment is carried out after transfer, an image or transferred mark remains weak.

In general, golf balls ready for marking are currently available in three different forms: a two-piece golf ball having an ionomer resin cover which has been plasma treated on the surface, a two-piece golf ball having an ionomer resin cover which has been sand blasted and plasma treated on the surface, and a thread wound golf ball having a white surface coating of urethane resin. None of the conventional transfer foils are successful in transferring ink marks to any of these three types of golf balls and compatible with subsequent urethane coating so that the transferred ink marks are satisfactory in physical strength.

SUMMARY OF THE INVENTION

Therefore, a primary object of the present invention is to provide a transfer foil which allows for transfer operation at relatively low temperature with a flat rubber pad, affords an ink mark which is reactive with subsequent urethane coating so that the ink mark becomes durable after the urethane coating, and accommodates for all types of golf balls. Another object of the invention is to provide a method for preparing a golf ball using the same transfer foil. A further object of the invention is to provide a golf ball having a durable mark borne thereon.

In a first aspect, the present invention provides a transfer foil for use in marking a golf ball. The transfer foil includes a base film and an ink layer of single-layer structure deposited thereon. The ink layer is formed of a urethane resin having a hydroxyl value of 0.2 to 15, which is reactive with isocyanate groups available from a two-part urethane resin composition to be coated onto the golf ball after the ink layer is transferred from the foil to the golf ball. In one preferred embodiment, the ink layer further includes about 1 to 100 parts by weight of a vinyl chloride-vinyl acetate copolymer and/or about 1 to 30 parts by weight of silica per 100 parts by weight of the urethane resin.

In a second aspect, the present invention provides a marked golf ball comprising on its surface a marking of an ink composition and a resin coating over the marking of a two-part urethane resin composition. A main component of the ink composition is a urethane resin having a hydroxyl value of 0.2 to 15. Then isocyanate groups available from the two-part urethane resin composition react with the urethane resin in the ink composition so that the marking is tough and durable. In one preferred embodiment, the ink composition further includes about 1 to 100 parts by weight of a vinyl chloride-vinyl acetate copolymer and/or about 1 to 30 parts by weight of silica per 100 parts by weight of the urethane resin.

In a third aspect of the present invention, a golf ball is prepared by placing the transfer foil over an unmarked golf ball, transferring the ink layer from the foil to the golf ball surface to form a marking thereon, coating a two-part urethane resin composition onto the golf ball surface so as to cover the marking, and drying and curing the coating.

BRIEF DESCRIPTION OF THE DRAWINGS

The only figure.

BEST MODE FOR CARRYING OUT THE INVENTION

Figure 1:
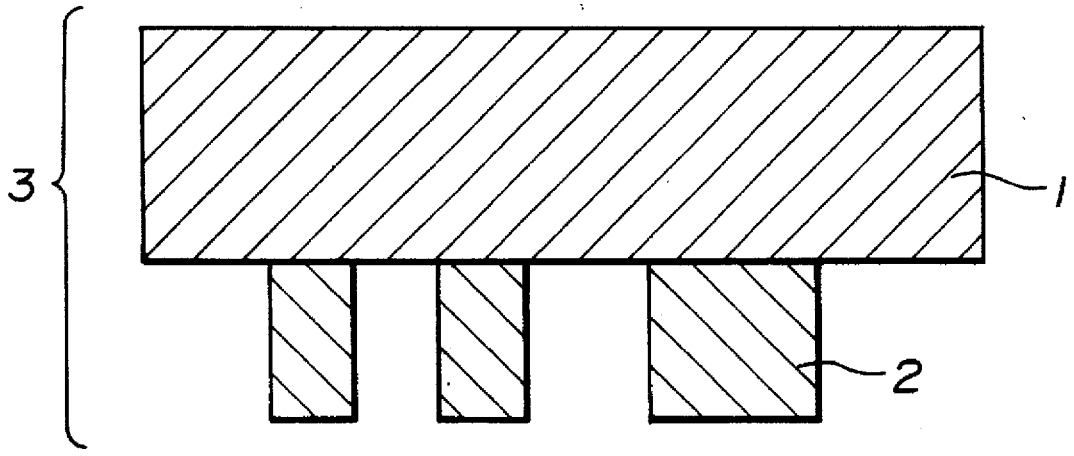
FIG. 1 is a schematic cross-sectional view of a transfer foil according to the present invention.

Referring to FIG. 1, there is illustrated a transfer foil according to one embodiment of the present invention. The transfer foil 3 includes a base film 1 and an ink layer 2 formed thereon. The ink layer 2 is generally printed in a pattern to represent a desired marking.

The base film 1 used in the transfer foil may be made of any of conventional resins including polyethylene, polypropylene, polyethylene terephthalate, and polyethylene naphthalate. Biaxially oriented polypropylene (OPP) films having a gage of about 12 to 50 μm are preferred for smooth conformity to dimples on the golf ball, adequate adhesion to the ink layer, and strength to withstand printing.

The ink layer 2 is formed of an ink composition comprising a urethane resin having a hydroxyl (OH) value of 0.2 to 15 as a vehicle and a pigment or dye as a coloring agent. The urethane resin is fully flexible, well conforms to dimples, and affords adhesion to the base film which is adequate during printing, but allows smooth transfer to the golf ball. The last factor means that the adhesion between the ink layer (or urethane resin) and the golf ball surface (or the substrate to which the ink layer is to be transferred) is greater than the stripping force required to strip the ink layer from the base film. Within the hydroxyl value range of 0.2 to 15, the urethane resin is reactive with isocyanate groups available from a two-part urethane resin composition to be spray coated onto the golf ball after the ink layer is transferred from the foil to the golf ball. Then the ink layer or marking is firmly fixed on the golf ball surface. With a hydroxyl value of more than 15, blocking occurs during printing. A urethane resin having a hydroxyl value of less than 0.2 is less reactive with the urethane resin composition to be subsequently coated.

In one preferred embodiment, the ink composition further includes about 1 to 100 parts by weight of a vinyl chloride-vinyl acetate copolymer and/or about 1 to 30 parts by weight of silica per 100 parts by weight of the urethane resin. These components are effective for improving blocking or adjusting the stripping force from the base film.

In the practice of the present invention, a golf ball is prepared by placing the transfer foil over an unmarked golf ball and pressing the foil against the ball at a relatively low temperature to transfer the ink layer from the foil to the ball surface to form a marking thereon. To this end, an up-and-down transfer machine is preferably used. A flat rubber pad may be used to press the foil against the ball.

A two-part urethane resin composition which is often referred to a two-package type urethane resin paint is then spray coated onto the ball surface so as to cover the marking, dried and cured. The marking is well wettable with the two-part urethane resin composition. Hydroxyl groups are available from the urethane resin of the ink layer while isocyanate groups are available from the two-part urethane resin composition. The hydroxyl groups react with the isocyanate groups to form a firm bond between the ink layer or marking and the urethane coating. Thus the marking has higher strength than conventional markings and is fully durable. Any desired one of well-known two-part urethane resin composition may be used. It may be coated by any desired technique although spray coating is advantageous.

The golf balls to which the ink layer or marking can be transferred from the transfer foil according to the invention include multilayer solid golf balls such as one-, two- and three-piece solid golf balls as well as thread wound golf balls.

The present invention affords many advantages. The transfer foil of the invention permits an ink layer or marking to be transferred to a golf ball with a flat rubber pad and at a relatively low temperature. The marking is receptive to the urethane resin composition to be subsequently coated. The resulting marking is strong and durable. Since a golf ball can be prepared by pressing the transfer foil to a golf ball in a conventional manner at a relatively low temperature to transfer the ink layer from the foil to the ball surface to form a marking thereon, coating a two-part urethane resin composition onto the ball surface so as to cover the marking, and drying and curing the coating, a durable marking can be simply made on any type of golf ball.

EXAMPLE

Examples of the present invention are given below by way of illustration and not by way of limitation.

Example 1

An ink composition as shown below was printed on a biaxially oriented polypropylene film of 22 μm thick to form a pattern of ink layer of 1 μm thick, yielding a transfer foil.

| Ink composition | Parts by weight |
|---|---|
| Urethane resin (OH value 3) | 50 |
| Carbon black | 20 |

Example 2

An ink composition as shown below was printed on a biaxially oriented polypropylene film of 22 μm thick to form a pattern of ink layer of 1 μm thick, yielding a transfer foil.

| Ink composition | Parts by weight |
|---|---|
| Urethane resin (OH value 8) | 50 |
| Vinyl chloride-vinyl acetate copolymer | 5 |
| Carbon black | 20 |

Example 3

An ink composition as shown below was printed on a biaxially oriented polypropylene film of 22 μm thick to form a pattern of ink layer of 1 μm thick, yielding a transfer foil.

| Ink composition | Parts by weight |
|---|---|
| Urethane resin (OH value 8) | 50 |
| Silica | 3 |
| Carbon black | 20 |

Comparative Example 1

An ink composition as shown below was printed on a biaxially oriented polypropylene film of 22 μm thick to form a pattern of ink layer of 1 μm thick, yielding a transfer foil. This corresponds to JP-A 183285/1983.

| Ink composition | Parts by weight |
|---|---|
| Nitrocellulose | 10 |
| Polyamide resin | 4.5 |
| Carbon black | 10 |
| Silica | 3 |
| Phthalate plasticizer | 5 |
| Polyethylene wax | 1 |

Each of these transfer foils was placed in pressure contact with various golf balls by pressing against the foil a silicone rubber pad of 2 mm thick heated at 130° C. The golf balls were a golf ball having an ionomer resin cover which was plasma treated on the surface (Ball 1), a golf ball having an ionomer resin cover which was plasma treated and sand blasted on the surface (Ball 2), and a golf ball having a surface layer of a two-part reactive urethane resin composition (Ball 3). On the thus marked golf balls, a clear urethane paint (two-part reactive urethane resin coating liquid) was spray coated, dried, and cured. It was observed how the marks were wetted with the coating liquid during electrostatic spray coating. Wetting was rated "O" for good wetting, "Δ" for wetting with some repellence, and "X" for repellence.

The following tests were carried out on the marked and painted golf balls. To examine the ease of transfer of the transfer foil, it was visually observed whether the ink layer was completely transferred to the golf ball surface, that is, the transferred mark was visually examined. The transfer is rated "O" for excellent, "Δ" for transfer with some portions remained untransferred, and "X" for no transfer.

The transferred mark was examined for physical properties by impact and abrasion tests. The impact test was carried out by throwing the golf ball against an iron plate at a speed of 45 m/sec., repeating the throw 200 times, and visually observing a degree of damage on the mark. The abrasion tests were a sand abrasion test (1) and a sand/water abrasion test (2). The sand abrasion test (1) was carried out by admitting sand and the ball in a ball mill (porcelain pot), rotating the mill for 2 hours, and visually observing the ball for stripping of the mark. The sand/water abrasion test (2) was carried out by admitting equal amounts of sand and water in a ball mill (porcelain pot) together with the ball, rotating the mill for 4 hours, and visually observing the ball for stripping of the mark.

The results are shown in Table 1.

TABLE 1

| | Ball type | Ease of transfer | Wetting | Impact test | Abrasion test Sand | Abrasion test Sand/water |
|---|---|---|---|---|---|---|
| E 1 | 1 | O | O | O | O | O |
| | 2 | O | O | O | O | O |
| | 3 | O | O | O | O | O |
| E 2 | 1 | O | O | O | O | O |
| | 2 | O | O | O | O | O |
| | 3 | O | O | O | O | O |
| E 3 | 1 | O | O | O | O | O |
| | 2 | O | O | O | O | O |
| | 3 | O | O | O | O | O |
| CE1 | 1 | X | — | — | — | — |
| | 2 | O | Δ | O | O | O |
| | 3 | X | — | — | — | — |

It is evident that the transfer foils of Examples 1 to 3 are satisfactory in transfer to all the three balls and their transferred marks were free of distortion, not repellent to the subsequent electrostatic painting, and the painted balls were fully resistant to impact and abrasion.

There has been described a transfer foil having an ink layer of specific urethane resin on a base film whereby an ink mark can be effectively transferred to a golf ball at a relatively low temperature by means of a flat rubber pad. The transferred ink mark is not repellent to a paint to be subsequently spray coated, but reactive with the paint so that the mark is firmly fixed. The thus obtained golf ball has a durable mark borne thereon. The method using the transfer foil enables to provide the golf ball surface with a durable mark in a simple manner. An ink mark can be transferred from the transfer foil to balls having a variety of surface states.

Japanese Patent Application No. 169547/1994 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A transfer foil for use in marking a golf ball, comprising a base film and an ink layer thereon, said ink layer being comprised of a urethane resin having a hydroxyl value of 0.2 to 15, said hydroxyl of the urethane resin being reactive with isocyanate groups available from a two-part urethane resin composition to be spray coated onto the golf ball after the ink layer is transferred from the foil to the golf ball.

2. The transfer foil of claim 1 wherein said ink layer further includes 1 to 100 parts by weight of a vinyl chloride-vinyl acetate copolymer per 100 parts by weight of the urethane resin.

3. A method for preparing a golf ball comprising the steps of:

placing a transfer foil as set forth in claim 2 over a golf ball, transferring the ink layer from the foil to the golf ball surface to form a marking thereon, coating a two-part urethane resin composition onto the golf ball surface so as to cover the marking, and drying and curing the coating.

4. The transfer foil of claim 1 or 2 wherein said ink layer further includes 1 to 30 parts by weight of silica per 100 parts by weight of the urethane resin.

5. A method for preparing a golf ball comprising the steps of:

placing a transfer foil as set forth in claim 4 over a golf ball, transferring the ink layer from the foil to the golf ball surface to form a marking thereon, coating a two-part urethane resin composition onto the golf ball surface so as to cover the marking, and drying and curing the coating.

6. A method for preparing a golf ball comprising the steps of:

placing a transfer foil as set forth in claim 1 over a golf ball, transferring the ink layer from the foil to the golf ball surface to form a marking thereon, coating a two-part urethane resin composition onto the golf ball surface so as to cover the marking, and drying and curing the coating.

7. A marked golf ball comprising on its surface a marking of an ink composition primarily comprising a urethane resin having a hydroxyl value of 0.2 to 15 and a resin coating over the marking comprising a two-part urethane resin composition, said urethane resin composition having isocyanate groups which have reacted with the urethane resin in the ink composition.

8. The golf ball of claim 7 wherein said ink composition further includes 1 to 100 parts by weight of a vinyl chloride-vinyl acetate copolymer per 100 parts by weight of the urethane resin.

9. The golf ball of claim 7 or 8 wherein said ink composition further includes 1 to 30 parts by weight of silica per 100 parts by weight of the urethane resin.

* * * * *